US008783237B2

(12) United States Patent
Torre et al.

(10) Patent No.: US 8,783,237 B2
(45) Date of Patent: Jul. 22, 2014

(54) PELLET-LOADING SYSTEM FOR SPORTING RIFLES OR PISTOLS

(75) Inventors: Victor Tresserras Torre, Barcelona (ES); Julian Arnedo Vera, Barcelona (ES)

(73) Assignee: Gamo Outdoor, SL, Barcelona (ES)

( * ) Notice: Subject to any disclaimer, the term of this patent is extended or adjusted under 35 U.S.C. 154(b) by 170 days.

(21) Appl. No.: 13/578,936

(22) PCT Filed: Feb. 16, 2010

(86) PCT No.: PCT/ES2010/070085
§ 371 (c)(1), (2), (4) Date: Oct. 11, 2012

(87) PCT Pub. No.: WO2011/101503
PCT Pub. Date: Aug. 25, 2011

(65) Prior Publication Data
US 2013/0206125 A1 Aug. 15, 2013

(51) Int. Cl.
*F41B 11/00* (2013.01)

(52) U.S. Cl.
USPC ..... 124/45

(58) Field of Classification Search
USPC ..... 124/45, 49, 50, 51.1, 73, 74
See application file for complete search history.

(56) References Cited

U.S. PATENT DOCUMENTS

| | | | | |
|---|---|---|---|---|
| 3,789,891 | A * | 2/1974 | Bosch | 141/331 |
| 4,164,929 | A * | 8/1979 | Liepins et al. | 124/76 |
| 4,881,517 | A | 11/1989 | Wackrow | |
| 7,231,914 | B2 * | 6/2007 | Hatcher | 124/83 |
| 2006/0266342 | A1 | 11/2006 | Teipel et al. | |
| 2011/0186027 | A1 | 8/2011 | Casas Salva | |

FOREIGN PATENT DOCUMENTS

| | | |
|---|---|---|
| ES | 8705623 | 7/1987 |
| GB | 685700 | 1/1953 |

* cited by examiner

*Primary Examiner* — John Ricci
(74) *Attorney, Agent, or Firm* — RatnerPrestia

(57) ABSTRACT

It comprises a barrel (1), a casing (6) joined to said barrel, with an aperture (7), a pellet-loading element (2) arranged inside the casing (6), with a notch (3) that ends facing the barrel (1) mouth (4) in the open or pellet-loading position, a handle (5) firmly joined to the pellet-loading element that protrudes beyond the casing (6) through the aperture (7) that rotates the pellet-loading element (2) from the closed position to the open position and vice versa, with referred handle (5) resting on a first side (11) of said aperture (7) and a spring pusher (8), characterised in that it comprises a spring (9) between the barrel (1) and pellet-loading element (2), and a partial necking (10) on the first side (11) of the aperture (7) along which necking (10) the handle (5) moves from the open position to closed position and vice versa, during which same time it moves the pellet-loading element (2) away from the mouth (4) by action of the spring (9), each time the handle (5) is at the necking (10).

5 Claims, 5 Drawing Sheets

PELLET-LOADING SYSTEM FOR SPORTING RIFLES OR PISTOLS

Pellet-loading system for sporting rifles and pistols of the type comprising a barrel, a casing joined to said barrel, with an aperture, a pellet-loading element arranged inside the casing, with a notch that ends facing the barrel mouth in the open or pellet-loading position, a handle firmly joined to the pellet-loading element that protrudes beyond the casing through the aperture that rotates the pellet-loading element from the closed position to the open position and vice versa, with referred handle resting on a first side of said aperture and a spring pusher, characterised in that it comprises a spring between the barrel and pellet-loading element, and a partial necking on the first side of the aperture along which the handle moves from the open position to closed position and vice versa, during which same time it moves the pellet-loading element away from the mouth by action of the spring, each time the handle is at the necking.

BACKGROUND OF THE INVENTION

The applicant firm and the inventors are known in the sporting rifle and pistol sector as great innovators, especially regarding compressed air of $CO_2$ rifles or pistols. Along these lines of improvement, this patent refers to a loading system for the cited rifles and pistols.

There are different pellet-loading systems for sporting rifles and pistols. One is described in European Patent 0467819 from the same applicant firm in 1991, which describes an air rifle of tiltable barrel, of a customary type, serving as a lever to a hinged levers mechanism, designed to compress the spring of the compression chamber, likewise of a customary type, mounted on the butt-stock, said barrel comprising at its rear end a first sub-assembly which essentially and respectively comprises a passing hole designed to receive a cross pin and a recess housing a catch, respectively designed for its articulation and locking on a second sub-assembly constituted by a fork ending in a cylindrical portion made integral with said compression chamber, and with an axial duct extending there through having a cylindrical section which communicates with the compression chamber, characterised in that said two sub-assemblies and which allow to assure the connection, articulation and centring between, on one side the barrel, and on the other side, the compression chamber, of customary type of an air riffle of the hinged barrel type, are obtained each of them by means of a single injection moulding operation namely by injection of a suitable material, namely plastic material of high resistance and mechanical performance, and in that they comprise: a) regarding to the first one which is designed to be made integral to the rear part of the barrel, forming at the same time a complete casing of the barrel: the opening passage designed for its articulation to the cross pin, the recess, designed to house the locking catch, the opening for connection of a lever of said hinged compression lever mechanism, a rear part of said casing leaves a rear part of said barrel protruding thereof; b) concerning to the second one designed to be made integral to the front part of the compression chamber, adjustable inserted: an opening, at both limbs of the fork designed to the mounting of the articulation cross pin; a groove, on the cylindrical portion designed to lodge circular means, particularly of O-ring seal type, providing an airtight connection seal; some open passages, through said cylindrical portion, and said compression chamber, housing cross locking pins for securing said portion and the end of the stroke of the piston with a spring; at the fork bottom between their two parallel fork limbs, a flat intermediate face, limited by a wall located below an opening where ends said axial duct, said wall bearing on the side nearer to said opening a rabbet of half cylindrical shape, centred with respect to said opening, to serve as a support for the barrel rear protruding section, and for axially centring the axis of the barrel body in line with said axial duct, and on the opposite side of said opening of the axial duct an inclined plane is situated in front of the locking element in the riffle firing position, said wall being laterally extended by two side profiles that secure the stepped connection with the flat intermediate face and provide the barrel centring and reinforcement functions.

Another pellet-loading system is the one proposed by the same company in Spanish Patent No 9101685 (ES2038537) of 1991, which refers to a weapon propelled by a pressurised fluid with double ammunition loading gun in which said ammunition is hand placed at the barrel rear mouthpiece, or automatically fed by a loading device, unit by unit, to a recess with which the barrel is aligned in a firing position said loading device comprising a tubular body closed at one end, with a spring supported on its bottom and an actuator linked to said spring allowing to store ammunition which is delivered, unit by unit, through the opposite open end of said tubular body, said tubular loading device being articulated by one end, and its distal free end portion remain located, within a guiding groove, a limiting stop holding said end portion, pushed against said stop by the action of a spring, in such a way that the geometrical axis of the loading device remains facing a suitably sized recess formed on the bottom of said groove, that may receive, when facing the loading device, a single ammunition unit, said recess communicating with a fluid propellant source and the gun barrel, tiltable articulated at the barrel shell, is arranged on the same articulate plane as the loading device, so that, when the weapon is closed, it is moved by said barrel, it is facing said housing head on, with maximum adjustment, ready to fire.

In 1985, the same firm also developed Spanish Patent No 0551101 (ES8705623), which refers to a projectile loading system in compressed air or gas pistols, characterised in that it is based on the arrangement of a loading mechanism, articulated laterally in a rear area of barrel, whose mechanism is made to oscillate manually between an open position, with the loader, in this position, receiving a single projectile aligned with the barrel, ready to be fired. The projectile storage tube is fitted with a longitudinal slot along which a spigot is guided and maintained in an inactive position against the far end of a notch by a spring.

Utility Model No 8802566 (ES1007337) is another loading system from the applicant company, of 1988, which describes a loading mechanism for compressed air rifles characterised in that it comprises a loader block with an orifice, a tab and a mounting-hole necking and a manual lever, the loading block of which is capable of translation in a transversal direction to the rifle longitudinal axis, the translation of which determines two end positions, one open end able to receive a projectile from outside, either manually of from a fed chamber and another closed end, in which the mentioned orifice coincides with barrel bore in the firing position, with this coincidence being ensured by the stop determined by a tab on the air compression chamber.

Lastly, it is worthwhile citing U.S. Pat. No. 4,881,517, "AIR GUNS", 1988, from BSA GUNS (UK) Limited, now GAMO OUTDOORS, S.L., which refers to an air gun having a fixed barrel mounted on a body and a source of compressed air or gas housed in the body has a device for enabling a pellet to be inserted directly into the barrel. It comprises a breech block is angularly movable between a loading position in which the breech is exposed and a firing position in which the breech is closed. In the embodiment shown the breech block is cylindrical and is rotatably mounted.

BRIEF DISCLOSURE OF THE INVENTION

This invention is an improvement of the pellet loading systems in sporting rifles and pistols based on compressed air or $CO_2$.

The closest document is U.S. Pat. No. 4,881,517. This patent attempts to resolve the problem of loading the pellets, most of which are made of lead.

It employs a system that halfway between the Mauser system, in which the pellet or projectile is located outside the breech to be subsequently moved forward and fitted into the breech and the folding barrel system in which the projectile is positioned directly in the barrel, with the user subsequently closing the rifle.

This invention is intended to improve this US patent. The inventors have realised that, occasionally, if the pellets are not correctly inserted inside the barrel, the rotation of the pellet-loading mechanism could damage the pellet and interfere with its desired trajectory, thus losing accuracy because the pellet does not perform as desired along its trajectory.

Thus, the inventors have developed a new pellet-loading system that ensures the pellet is inserted into the barrel without being pinched when the pellet-loading mechanism, rotates, moreover, it is a system that always operates within the rifle or pistol and is therefore much easier to manipulate from the user's comfort point of view.

Tests have shown that this is a highly reliable system because the pellet is always correctly positioned inside the barrel and, in addition, is never pinched by the cited pellet-loading element.

As can be seen, it is easy to use and does not require any great effort to go from the open to closed positions and vice versa.

One objective of this invention is a pellet-loading system for sporting rifles and pistols of the type comprising a barrel, a casing joined to said barrel, with an aperture, a pellet-loading element arranged inside the casing, with a notch that ends facing the barrel mouth in the open or pellet-loading position, a handle firmly joined to the pellet-loading element that protrudes beyond the casing through the aperture that rotates the pellet-loading element from the closed position to the open position and vice versa, with referred handle resting on a first side of said aperture and a spring pusher, characterised in that it comprises a spring between the barrel and pellet-loading element, and a partial necking on the first side of the aperture along which the handle moves from the open position to closed position and vice versa, during which same time it moves the pellet-loading element away from the mouth by action of the spring, each time the handle is at the necking.

BRIEF DESCRIPTION OF THE DRAWINGS

In order to facilitate the description this report includes five sheets of drawings that represent a practical exemplary embodiment which is for guideline purposes and does not limit the scope of this invention.

EXEMPLARY EMBODIMENT OF THIS INVENTION

Figure 1:
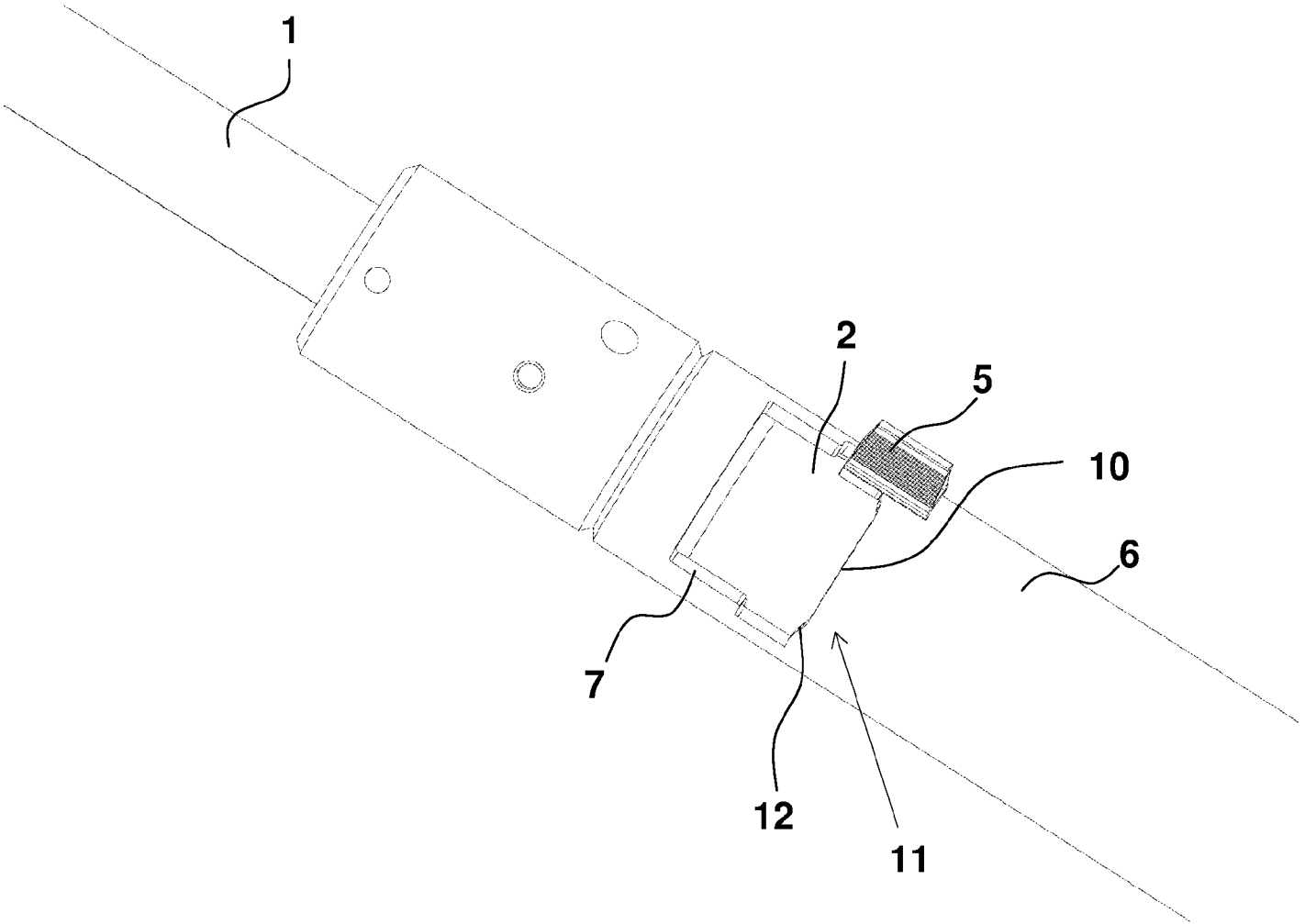
FIG. 1 is a partial view of a sporting rifle with the system in the closed position.

Thus, FIG. 1 illustrates a barrel 1, a casing 6, an aperture 7, with its first side 11, its necking 10, its bevelled edge 12 and a pellet-loading element 2, with its handle 5.

Figure 2:
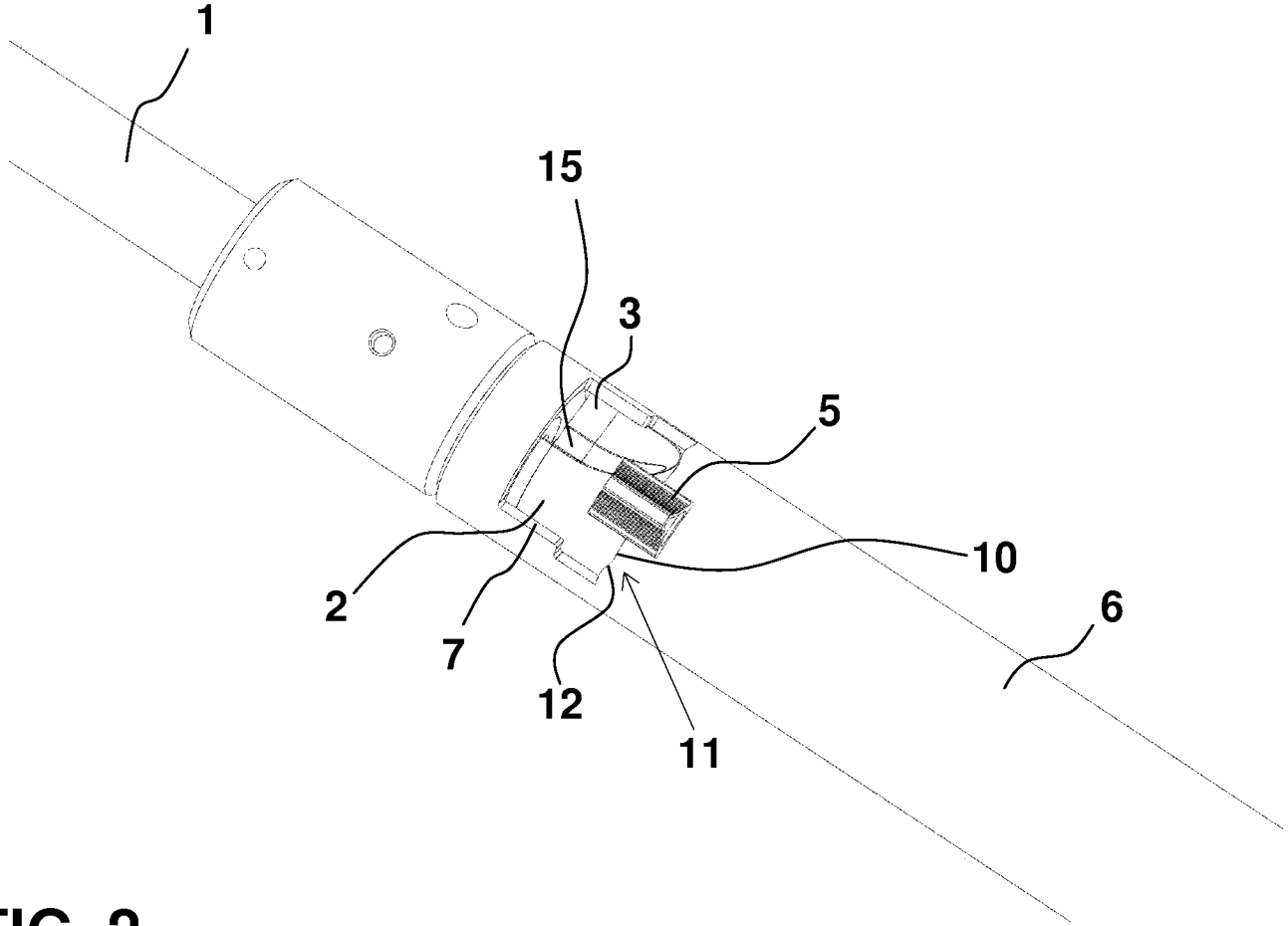
FIG. 2 is a partial view of a sporting rifle with the system in an intermediate position.

FIG. 2 shows the barrel 1, a casing 6, aperture 7 with its first side 11, its necking 10, its bevelled edge 12 and a pellet-loading element 2, with its handle 5, its notch 3 and groove 15.

Figure 3:
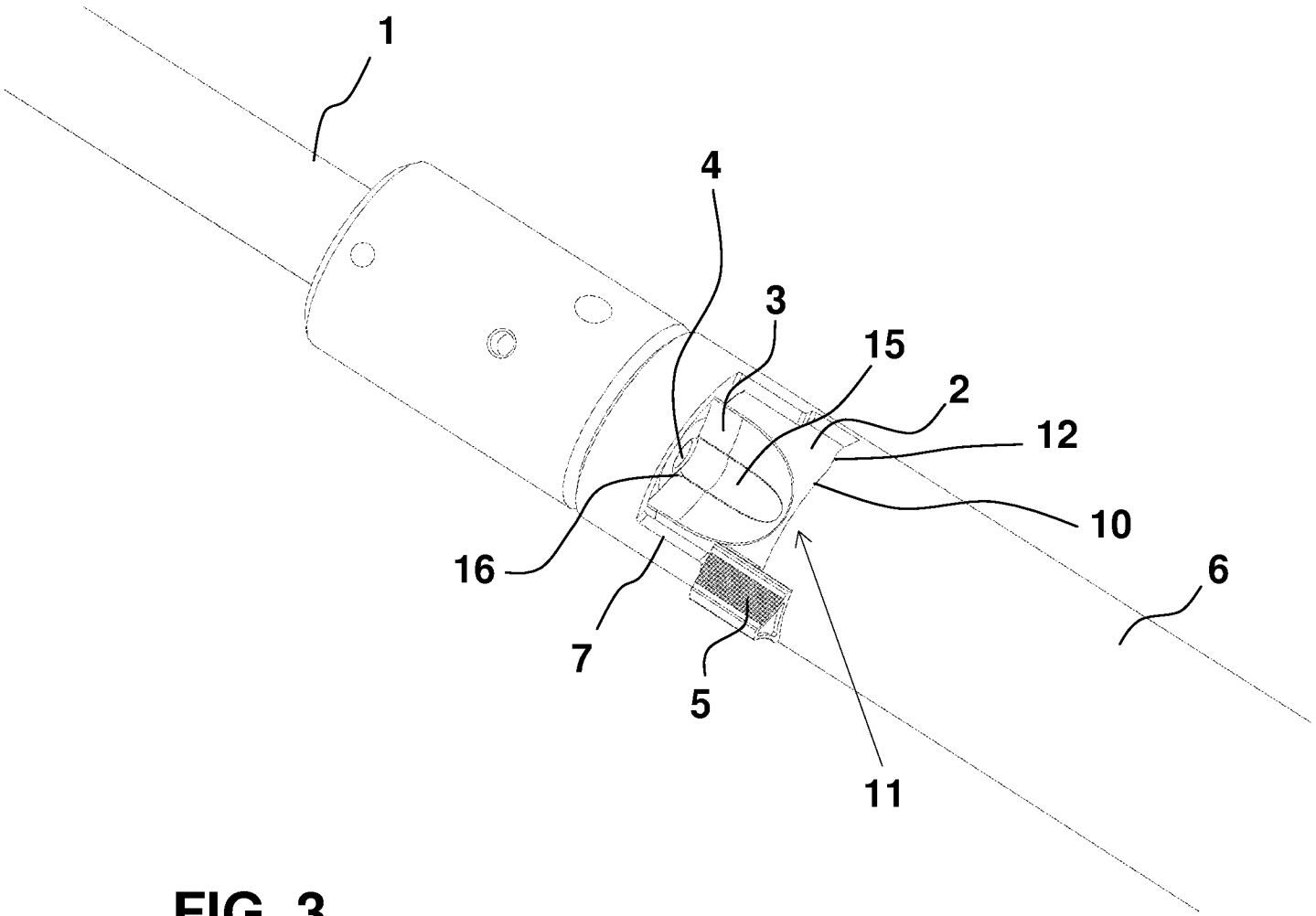
FIG. 3 is a partial view of a sporting rifle with the system in the open position.

FIG. 3 illustrates the barrel 1, with its mouth 4, casing 6, aperture 7 with its first side 11, its necking 10, its bevelled edge 12 and pellet-loading element 2, with its handle 5, its notch 3 and groove 15, with its blunt edge 16.

Figure 4:
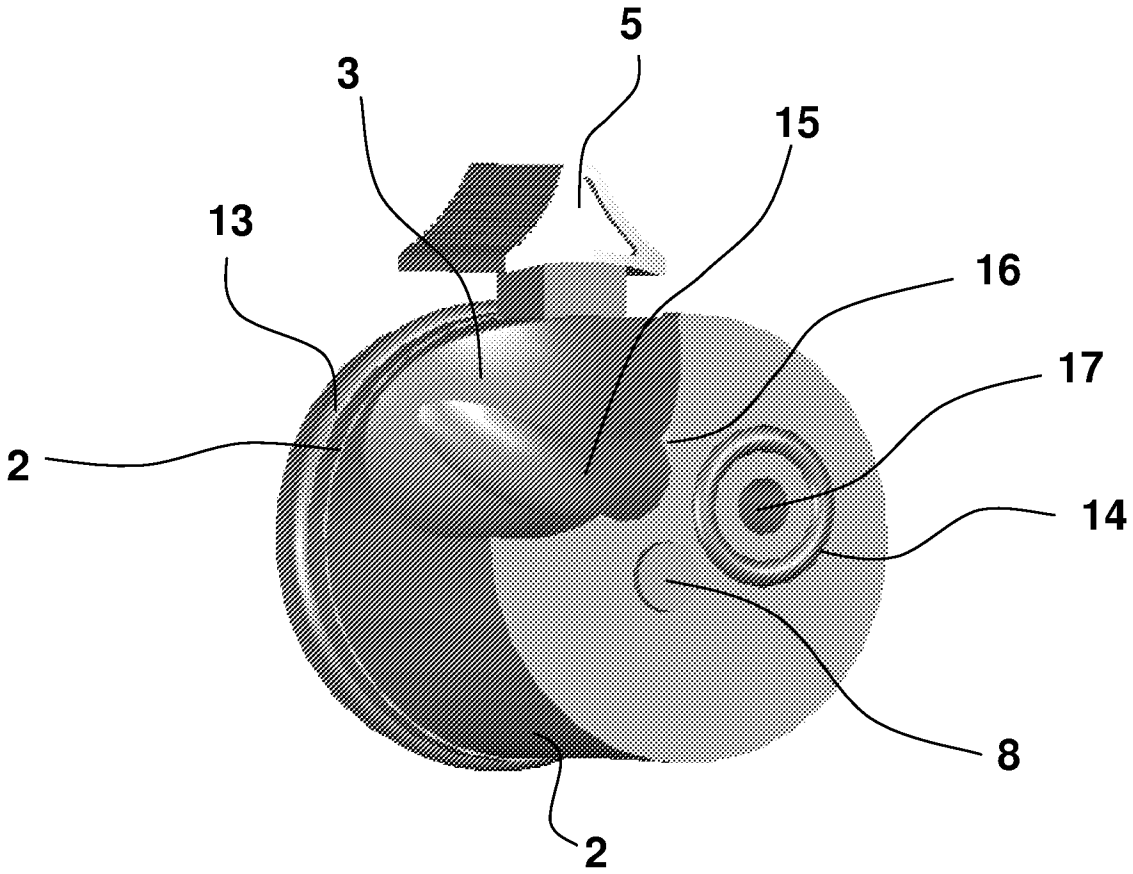
FIG. 4 is a close-up of a pellet-loading element.

FIG. 4 shows the pellet-loading element 2, handle 5, the notch 3, groove 15, with its blunt edge 16, a spring pusher 8, a first O-ring 13, a second O-ring 14 and a compressed air or $CO_2$ pipe 17.

Figure 5:
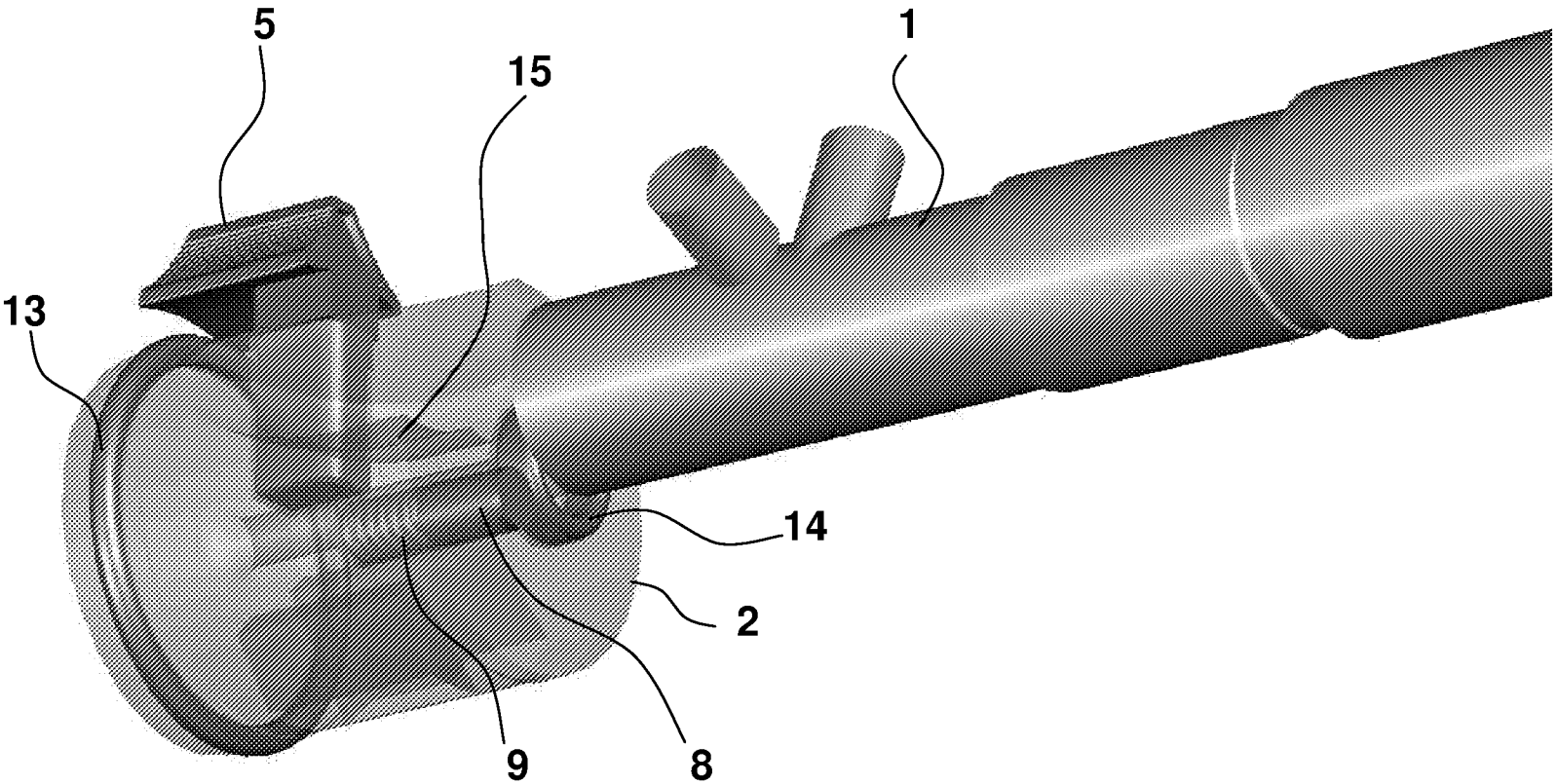
FIG. 5 is a perspective view from below with a transparency of the objective of this invention.

Lastly, FIG. 5 illustrates barrel 1, the pellet-loading element 2, with its handle 5, groove 15, the first O-ring 13, second O-ring 14, spring pusher 8 and spring 9.

In this way, in a specific exemplary embodiment, when the user desires to load a pellet into the rifle (this embodiment may also be for a pistol), he or she should proceed as follows.

Assuming that the rifle has initially been fired, the pellet-loading element 2 would be closed, as shown in FIG. 1, without the groove 15 being visible.

The rifle is then loaded, because, if not, the piston (not illustrated), pushed by the pusher spring (not illustrated) will push pellet-loading element 2 and prevent it from rotating or moving.

In order to load the pellet (FIG. 2), handle 5, which is firmly attached to pellet-loading element 2, is moved to the other end of aperture 7. Pellet-loading element 2 rotates inside casing 6, which can be seen through aperture 7. As can be seen in FIG. 5, there is a spring 9 that pushes pellet-loading element 2 away from barrel 1 so that, when handle 5 reaches necking 10 of first side 11, spring 9 separates from pellet-loading element 2 of barrel 1. This movement is especially important when the pellet has been loaded into barrel mouth 4, as will be described below.

Said spring 9 is controlled by a spring pusher 8, which is partially inserted inside spring 9 to prevent it losing its position during spring 8 compression/decompression movements.

Then when the other end of aperture 7 (FIG. 3) is reached, bevelled edge 12 moves the handle 5 forward in turn moving pellet-loading element 2 forwards, approaching barrel 1 when handle 5 reaches the end of its movement.

As can be seen in FIG. 3, in the open position, pellet-loading element 2 uncovers notch 3, where groove 15 is located facing barrel mouth 4.

Thus, when the user desires to insert the pellet into barrel mouth 4, said pellet is positioned in groove 15 of notch 3 and is pushed inside barrel mouth 4 and positioned inside said mouth 4.

Then, in order to fire the rifle, the user grips handle 5 and pushes it in the opposite direction, in other words, moving said handle 5 until pellet-loading element 2 is in the position illustrated in FIG. 1.

When handle 5 (FIG. 3) is moved and it reaches necking 10, spring 9 pushes pellet-loading element 2, separating it from barrel 1. This is very important because it prevents pellet-loading element 2 from rotating if the pellet is not correctly fitted inside barrel mouth 4, the same pellet-loading element 2 strikes the incorrectly positioned pellet and damages it. This means that if the pellet has been damaged, when the rifle is fired, the pellet trajectory will not be that desired.

When the movement of necking 10 ends, handle 5 leaves necking 10 and moves forward, positioning itself at the other side of the aperture (FIG. 1), thus moving pellet-loading element 2 towards the barrel mouth 4, with barrel mouth 4 facing towards compressed air or $CO_2$ pipe 17 positioned in pellet-loading element 2.

As can be verified, even when the pellet has not been pushed to the end, this new system does not allow the pellet to be damaged and it is similarly facing to compressed air or $CO_2$ pipe 17 in order to be fired.

It has been observed that, on occasions, the existence of bevelled edge 12 on aperture 7, located just before necking 10, which facilitates transit from aperture 7 to necking 10 helps to prevent the pellet from being pinched. In this way, at the same time that pellet-loading element 2 is rotating, is produced a gradual separation movement of pellet-loading element 2 with respect to barrel 1, the separation of which is not sudden, because it occurs just when it is moving over bevelled edge 12.

In fact, it can be calculated that when handle 5 passes over said bevelled edge 12, this moment coincides with the start of moving away of the pellet-loading element 2 from the mentioned barrel mouth 4.

In order to improve still further, if this is possible, the prevention of pellet pinching, groove 15 can optionally comprise blunt edge 16, arranged just to the side of the barrel mouth. This permits that, even when the pellet is not adequately inserted, blunt edge 16 would prevent damaging it and, at the same time, would smoothly push it inside barrel mouth 4.

This invention patent described a new pellet-loading system for sporting rifles or pistols. The examples herein mentioned do not limit this invention and, because of this, can have various applications and/or adaptations, all of which are within the scope of the following claims.

The invention claimed is:

1. A pellet-loading system for sporting rifles and pistols of the type comprising a barrel (1), a casing (6) joined to said barrel, with an aperture (7), a pellet-loading element (2) arranged inside the casing (6), with a notch (3) that ends facing the barrel (1) mouth (4) in the open or pellet-loading position, a handle (5) firmly joined to the pellet-loading element that protrudes beyond the casing (6) through the aperture (7) that rotates the pellet-loading element (2) from the closed position to the open position and vice versa, with referred handle (5) resting on a first side (11) of said aperture (7) and a spring pusher (8), characterised in that it comprises a spring (9) between the barrel (1) and pellet-loading element (2), and a partial necking (10) on the first side (11) of the aperture (7) along which necking (10) the handle (5) moves from the open position to closed position and vice versa, during which same time it moves the pellet-loading element (2) away from the mouth (4) by action of the spring (9), each time the handle (5) is at the necking (10).

2. A system, in accordance with claim 1 characterised in that from the open necking (10) position, it comprises a bevelled edge (12).

3. A system, in accordance with claim 2 characterised in that the moving of the handle (5) from the open position by said bevelled edge (12) coincides with the start of moving away of the pellet-loading element (2) from the mouth (4).

4. A system, in accordance with claim 3 characterised in that the groove (15) comprises a blunt edge (16).

5. A system, in accordance with claim 1 characterised in that the notch (3) comprises a groove (15) which, in the open position is facing the barrel mouth (4).

* * * * *